United States Patent [19]

Elsner et al.

[11] 4,075,857

[45] Feb. 28, 1978

[54] SHIELD-TYPE SUPPORT ASSEMBLIES FOR MINE WORKINGS

[75] Inventors: Burckhardt Elsner; Günter Lagodka, both of Lunen; Lubomir Plevak, Lunen, Horstmar; Harry Rosenberg, Ludinghausen, all of Germany

[73] Assignee: Gewerkschaft Eisenhutte Westfalia, Lunen, Germany

[21] Appl. No.: 734,934

[22] Filed: Oct. 22, 1976

[30] Foreign Application Priority Data

Oct. 25, 1975 Germany ..... 2547853

[51] Int. Cl.[2] ..... E21D 15/44

[52] U.S. Cl. ..... 61/45 D

[58] Field of Search ..... 61/45 D; 299/31–33; 248/357; 91/170 MP

[56] References Cited

U.S. PATENT DOCUMENTS

| | | | |
|---|---|---|---|
| 3,333,426 | 8/1967 | Jackson | 61/45 D |
| 3,397,544 | 8/1968 | Golla et al. | 61/45 D |
| 3,505,823 | 4/1970 | Bell | 61/45 D |

FOREIGN PATENT DOCUMENTS

| | | | |
|---|---|---|---|
| 1,242,540 | 6/1967 | Germany | 61/45 D |
| 1,277,790 | 9/1968 | Germany | 61/45 D |
| 2,025,138 | 2/1971 | Germany | 61/45 D |
| 2,114,317 | 9/1972 | Germany | 61/45 D |

*Primary Examiner*—Dennis L. Taylor

*Attorney, Agent, or Firm*—Sughrue, Rothwell, Mion, Zinn and Macpeak

[57] ABSTRACT

A shield-type support assembly for a mine working is composed of three substantially identical frames aligned side-by-side. Each frame has a floor sill structure which carries props capable of bracing a roof cap and the floor sill structure between the roof and floor of a mine working. A goaf shield is provided for each frame and these shields combine to screen off the goaf zone. The outer frames on the one hand and the central frame on the other are shiftable in alternation with the aid of shifting rams. One or more transverse arms extend across the forward regions of the frames and the or each arm is carried by the central frame floor sill structure. Guide devices are connected to the arm or arms and serve to guide the frames when shifted by the rams and the rams themselves transmit the shifting or reaction forces to the arm or arms.

The coupling between the floor sill structures of the frames permits relative vertical mobility therebetween to cope with variations in the floor level of the working.

12 Claims, 4 Drawing Figures

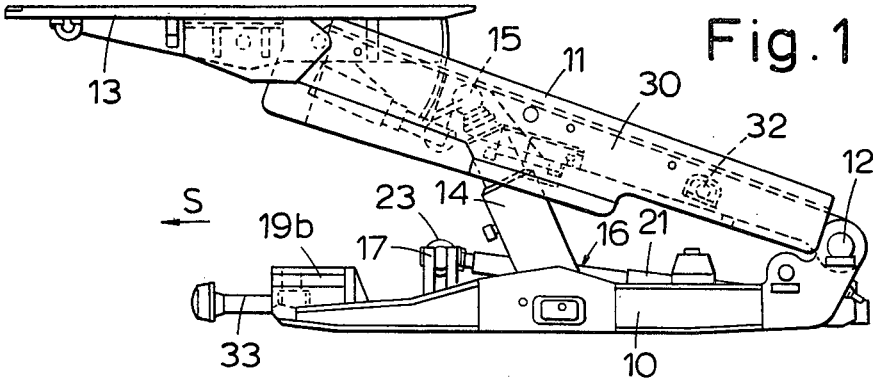
Fig. 1
Fig. 2
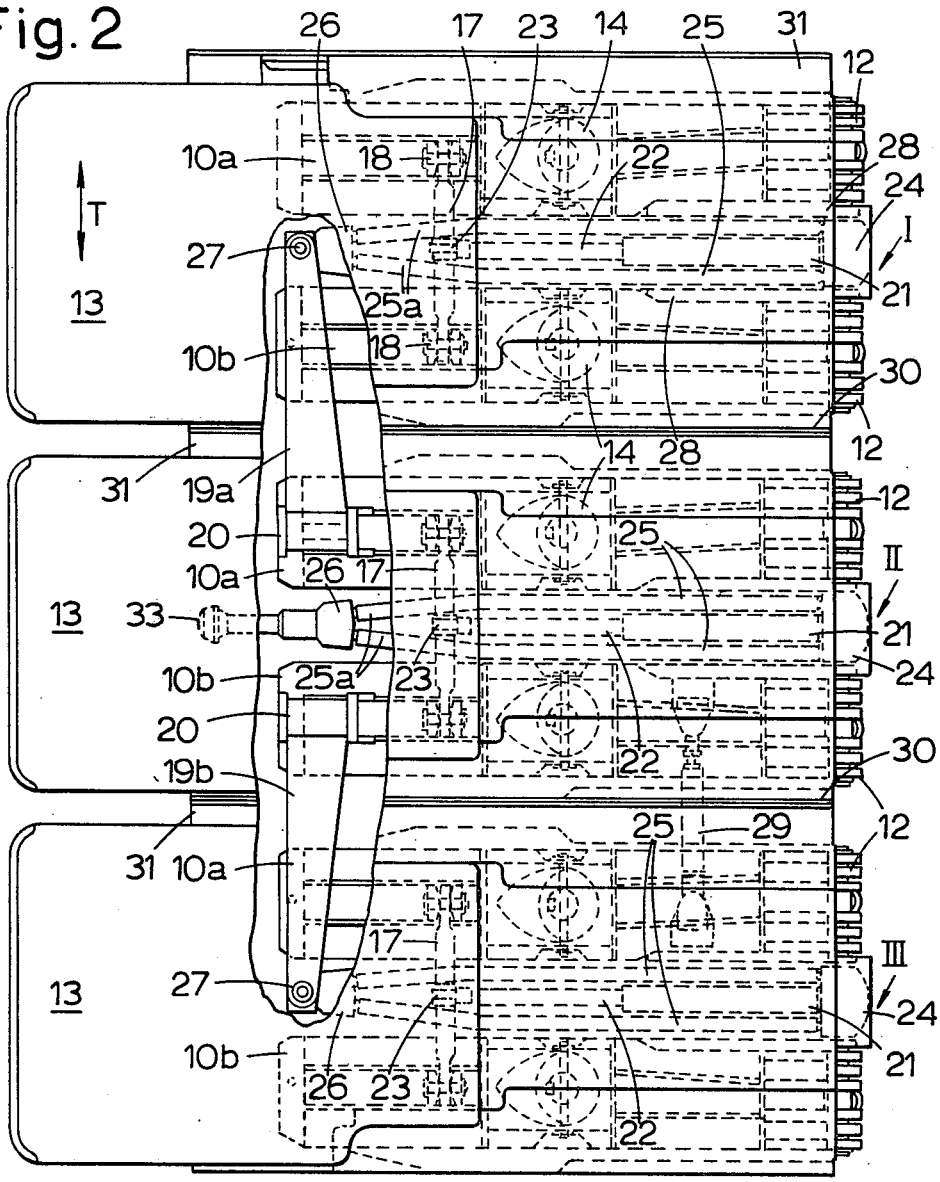

SHIELD-TYPE SUPPORT ASSEMBLIES FOR MINE WORKINGS

BACKGROUND TO THE INVENTION

The present invention relates to a shield support assembly for use in mine workings.

Known forms of support assemblies comprise individual frames arranged side-by-side and interconnected by guiding and shifting devices. Where the floor of the mine working is uneven or where there is a relatively steep incline or dip in the floor level problems arise in ensuring satisfactory guidance between the frames. These problems can be aggravated by the need to screen off the goaf or stowage zone with the aid of goaf shields provided on the frames.

A general object of the present invention is to provide an improved support assembly.

SUMMARY OF THE INVENTION

According to the present invention a shield support assembly comprises three individual frames arranged in side-by-side relationship and each capable of being braced between the floor and roof of a mine working, means for guiding the frames for relative shifting displacement, means for causing said relative shifting displacement between the central frame and the outer frames and transverse coupling means supported by the central frame and extending between the central frame and the outer frames wherein the guide means is connected to the transverse coupling means and the arrangement is such that relative vertical displacement can occur between the frames. The relative vertical displacement between the frames can be limited but nevertheless enables the assembly to cope with unevenness in the floor of the mine working or a steep inclination thereof. The shifting means can be in the form of conventional hydraulic rams connected directly or indirectly to the transverse coupling means. In one constructional form the transverse coupling means may be rigidly affixed to the central frame while in another constructional form the transverse coupling means can be connected to the central frame or otherwise for swinging about one or more axes parallel to the shifting direction which is usually aligned longitudinally with the frames and towards a mineral, e.g., coal, face.

In accordance with one embodiment of the invention the transverse coupling means is a transversally extending arm rigidly fixed to the central frame, the guide means comprises guide bars extending in the shifting direction and connected to the ends of the arm and slidably engaging in guide blocks carried by the outer frames, the engagement between the guide bars and guide blocks permitting relative pivotal movement and limited vertical movement therebetween. In this case the shifting rams can be connected between the transverse arm and the outer frames. Each ram can take an inclined disposition in a plan view of the assembly and the guide bars can then have a length only slightly greater than the stroke of the rams corresponding to a shifting step.

In another embodiment the transverse coupling means is composed of two transversally extending arms each connected to the central frame for pivoting about an axis parallel to the shifting direction and each connected at its end remote from the central frame to a pair of guide bars forming at least part of the guide means.

It may be preferred to provide each frame with a laterally divided floor sill structure with relatively vertically movable parts. Where the transverse coupling means comprises two arms as aforementioned the floor sill parts of the central frame can then be connected in a pivotal manner to a respective one of these arms. Each shifting ram can be arranged between a respective pair of guide bars preferably resilient, and disposed in toto between the floor sill parts of the outer frames. Each such ram can then be supported by a transverse yoke interconnecting the guide bars at their rear ends relative to the shifting direction. These yokes can be conveniently guided to link the floor sill parts of the outer rams and to permit pivoting and sliding between the yokes and the floor sill parts during shifting. The shifting rams may bear on further transverse yokes pivoted but rigid in the transverse direction in relation to the respective floor sill parts of the outer frames. Each pair of guide bars preferably converge at their front ends and adjoin a head piece pivoted on a vertical joint to a respective one of the transverse arms. A similar guide and shifting arrangement can be provided between the floor sill parts of the central frame and this arrangement can be connected or arranged to engage on a longwall conveyor for shifting purposes.

To guide the rear portions of the frames the shields thereof may be arranged in abutting relationship although other devices such as hydraulic units can be used to adjust and maintain the desired alignment between the frames.

The present invention also provides a shield support assembly comprising three frames arranged in side-by-side relationship, the frames having a floor sill structure carrying hydraulic props capable of bracing the individual frames between the roof and floor of a mine working, means for guiding the frames for relative shifting displacement, means for effecting relative shifting displacement between the central frame and the outer frames and transverse coupling means extending between the central frame and the outer frame and supported by the central frame, said transverse coupling means being connected to the guide means, wherein the transverse coupling means and the guide means permit relative vertical mobility to occur between the floor sill structure of the frames.

The invention may be understood more readily, and various other features of the invention may become apparent from consideration of the following description.

BRIEF DESCRIPTION OF DRAWINGS

Embodiments of the invention will now be described by way of examples only, with reference to the accompanying drawings, wherein:

FIG. 1 is a side view of a shield support assembly made in accordance with the invention;

FIG. 2 is a plan view of the assembly shown in FIG. 1 with part of the roof caps being removed for clarity;

DESCRIPTION OF PREFERRED EMBODIMENTS

Figure 3:
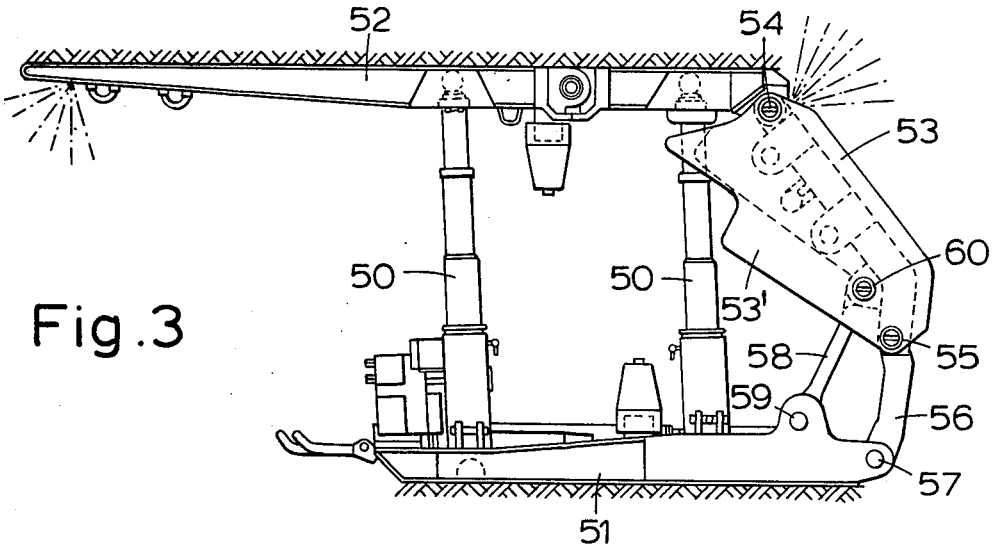
FIG. 3 is a side view of a further shield support assembly made in accordance with the invention.

As shown in FIGS. 1 and 2, a shield support assembly comprises three basically similar frames I, II, III arranged side-by-side in parallel relationship. Each frame I, II, III is composed of a floor sill structure 10 which supports two hydraulic telescopic props 14 connected to the floor sill structure 10 with the aid of ball-and-socket joints. The heads of the props 14 of each frame I, II, III are connected via ball-and-socket joints 15 to a goaf shield 11 which is pivoted to the rear of the sill structure 10 with a pivot joint 12. The shield 11 of each frame I, II, III extends across the entire width of the associated frame I, II, III and supports a roof cap 13 in an articulated manner.

The floor sill structure 10 of each frame I, II, III is effectively sub-divided in the longitudinal direction, i.e., in the shifting direction S (FIG. 1), and composed of separate sill parts 10*a*, 10*b* spaced apart laterally of the frame. A guide and shifting device 16 is interposed between the sill parts 10*a*, 10*b* of each frame I, II, III and these parts 10*a*, 10*b* are interconnected at their rear ends with the pivot joint 12 pertaining to the associated shield 11. At their front ends, i.e., nearest the mineral face, not shown, the sill parts 10*a*, 10*b* of each frame I, II, III are interconnected by means of a transverse yoke 17. As denoted by reference numerals 18 each yoke 17 is articulated to the respective sill parts 10*a*, 10*b* with pivot axes extending parallel to the shifting direction S thereby permitting relative vertical displacement between the front ends of the sill parts 10*a*, 10*b*.

The sill parts 10*a*, 10*b* of the central frame II are each connected to a transverse arm 19*a*, 19*b* by means of a pivot joint 20 with an axis also extending parallel to the shifting direction S. Each arm 19*a*, 19*b* takes the form of a plate tapering in width outwardly from the central frame II as shown in FIG. 2. The outer ends of the arms 19*a*, 19*b* are articulated with joints 27 with a vertical pivot axes to the guide and shifting devices 16 pertaining to the outer frames I, III. Each of the devices 16 employs a hydraulic shifting ram 21 having its piston rod 22 articulated as at 23 to the yoke 17 interconnected to the associated sill parts 10*a*, 10*b*. Each ram 21 is located between a pair of resilient guide rails or bars 25 forming part of the associated device 16. The bars 25 of each device 16 are interconnected at their rear ends with a further transverse yoke 24 which carries the cylinder of the associated ram 21. The yoke 24 of each device 16 is provided with transverse guide elements such as pins which slidably engage in guide tracks 28 provided at the sides of the sill parts 10*a*, 10*b* of the associated sill structure 10. These tracks 28 extend longitudinally of the frames I, II, III, i.e., in the shifting direction S and the guide elements engaging therein ensure the yoke 24 is displaceable in the shifting direction and is also able to pivot about an axis defined by the guide elements and extending transversally of the frame I, II, III in question. The front end portions of the bars 25 of each device 16 converge towards one another and are interconnected by a head piece 26. The head pieces 26 of the devices 16 pertaining to the outer frames I, III carry the joints 27 for the arms 19*a*, 19*b* referred to previously.

As can best be seen in FIG. 2, a hydraulic piston and cylinder unit 29 is provided between the sill structures 10 of the frames, II, III. The unit 29 is articulated to these sill structures 10 and serves to align the frames II, III over their rear end portions. This function is particularly intended for use where the working has an inclined floor so that the frame III is disposed at a lower level than the frame II and could tend to slide in the direction of the incline or dip.

The shield 11 of each frame I, II, III is of composite construction with a main wall facing the goaf or stowage zone and side walls 30, 31. The side wall 30 is rigidly affixed to the main wall and may be integral therewith while the other side wall 31 is displaceable in relation to the main wall. The side wall 31 of each shield 11 can be adjusted in the directions of arrow T (FIG. 1) by means of one or more hydraulic piston and cylinder units 32 interposed between the side wall 31 and the main wall of the shield 11. Each hydraulically extendible side wall 31 thus serves to vary the overall width of its shield 11 and during use each side wall 31 can be brought into engagement with the side wall 30 of the next-adjacent shield 11. In this way the shields 11 combine to screen off the assembly from the goaf zone and provide additional lateral guidance and support between the frames I, II, III.

FIG. 2 depicts the assembly in a basic operating position. If the rams 21 of the devices 16 of the outer frames I, III are subjected to pressure fluid so as to retract and then assuming the props 14 of the outer frames I, III, are set while the props of the central frame II are relieved, the entire central frame II will be shifted in direction S through the guide bars 25 of the devices 16 of the frames I, III and the arms 19*a*, 19*b*. The piston rods of the rams 21 in question are here supported by the yokes 17 acting through the sill parts 10*a*, 10*b* of the outer frames I, II as abutments. When the central frame II has been shifted in this manner the props 14 thereof can be set to brace the frame II between the floor and roof of the working. If now the props 14 of the outer frames I, III are relieved the rams 21 of the devices 16 of these outer frames, I, III can be charged with pressure fluid in a reverse sense so as to extend. In this case both outer frames I, III will be drawn up in the direction S by the piston rods 22 acting on the yokes 17. The cylinders of the rams 21 in question are here supported by the yokes 24 the bars 25 and the arms 19*a*, 19*b* acting through the sill parts of the central frame II as abutments. The guide and shifting device 16 provided for the central frame II is not essential for the shifting sequence described above but it is useful to couple the head piece 26 of this device 16 to a scraper-chain conveyor (not shown) which would normally extend alongside the mineral face and between a number of assemblies as described and the mineral face. As shown in FIG. 2, an extension with a thrust block 33 can be connected to the head piece 26 of the device 16 of the central frame II and the block 33 can exert thrust force of the conveyor in the direction S when the ram 21 of the device 16 is retracted. Such an operation can take place independently of the main frame shifting operation effected by the rams 21 of the outer frames I, III. Alternatively a positive connection can be established between the head piece 26 of the device 16 of the central frame II and the conveyor to thereby assist in anchoring the conveyor.

Since the floor sill structure 10 of each frame I, II, III is composed of the parts 10*a*, 10*b* which can perform limited relative vertical displacement and since the outer frames I, III are interconnected to the central frame II via the guide and shifting devices 16 and the arms 19*a*, 19*b* the individual frames I, II, III are particularly well adapted to adjust themselves to any unevenness in the floor beneath the sill structures 10. Such adjustment can moreover take place without adversely affecting the guidance between the frames I, II, III provided by the devices 16. During any vertical displacement to cope with changes in the floor level either or both the arms 19a, 19b can swivel about the pivot joints 20 while maintaining the necessary horizontal tractional rigidity.

Figure 4:
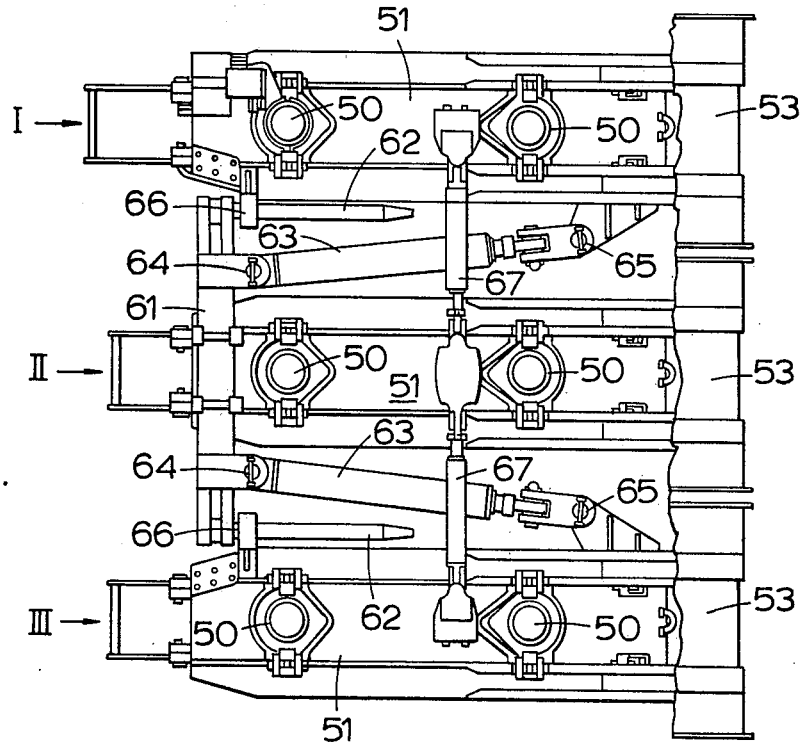
FIG. 4 is a plan view of the assembly shown in FIG. 3 with the roof caps removed for clarity.

In the assembly represented in FIGS. 3 and 4, three frames I, II, and III are again arranged side-by-side in parallel relationship. Each frame I, II, III is composed of a floor sill structure 51 which supports two hydraulic telescopic props 50 connected to the floor sill structure 51 with the aid of ball-and-socket joints. The heads of the props 50 of each frame I, II, III are connected via ball-and-socket joints to a multi-part roof cap 52. Each frame I, II, III has an upper goaf shield component 52 pivotably connected to the rear end of the associated roof cap 52 via connections or joints 54. A lower goaf shield component 56 combines with each upper shield component 52 to screen off the goaf or stowage zone from the frames I, II, III. Each lower goaf shield component 56 is pivotably connected to the associated upper goaf shield component 53 with joints or connections 55 and to the associated floor sill structure 51 with joints or connections 57. Guide members 58 serve to guide each shield 53, 56 when the associated props 50 extend or retract. These members 58 are pivotably connected to the shield components 53, 56 via joints or connections 60, 59. For each frame I, II, III the pivot axes of the joints 54, 55, 57, 59, 60 all extend parallel to one another and transversally thereof. In known manner the shields 53, 56 and their guided members 58 are designed so that the roof caps 52 can be raised and lowered by the props 50 without any appreciable movement towards or away from the mineral face of the working which extends transversally of the assembly and across the front ends of the frames I, II, III remote from the shields 53, 56.

In a generally similar manner to the assembly shown in FIGS. 1 and 3, the frames I, II, III of the assembly shown in FIGS. 3 and 4 are adapted to cope with unevenness in the floor level and are guided for relative displacement in the shifting direction towards the mineral face. More particularly as shown in FIG. 4, hydraulic rams 63 are provided for shifting the frames I, II, III and are located between the central frame II and each outer frame I, III. The rams 63 are inclined slightly in relation to the frames I, II, III and converge in the direction of the mineral face. Each ram 63 has its piston rod coupled with a universal-joint connection 65 to a bracket on the floor sill structure 51 of one of the respective outer frames I, III. The floor sill structure 51 of the central frame II is rigidly affixed to a transverse arm 61 which carries guide bars 62 extending generally perpendicular thereto. The guide bars 62 are preferably resilient and project between the central frame II and the outer frames I, III, parallel to the shifting direction. The guide bars 62 are relatively short in length (c.f., the bars 25 in FIG. 2) and just slightly greater than the full stroke of the rams 63 representing a complete shifting step. The floor sill structures 51 of the outer I, III are provided with guide blocks 66 which receive the guide bars 62 for slidable movement in the shifting direction. The guide blocks 66 have apertures through which the guide bars 62 extend and these apertures are shaped to provide limited vertical mobility for the bars 62. Relative pivoting and vertical displacements can thus occur between the front regions of the floor sill structures 51 to provide the adaptation for unevenness in the floor.

The guide system 61, 62, 66 acts to guide the front regions of the floor sill structure 51 in the shifting direction and in order to provide lateral support and guidance at the rear end regions, the shield components 53 can each have an adjustable side wall 53' moved by hydraulic units (not shown) and engaging on the fixed side wall of an adjacent component 53 in the manner described hereinbefore in the context of the assembly shown in FIGS. 1 and 2. As shown in FIG. 4, however, hydraulic piston and cylinder units 67 are provided between the central frame II and the outer frames I, III. These units 67 are located at the central regions of the floor zones of the frames I, II, III and serve to align the frames I, II, III and prevent deviations from their mutually parallel relationship. The units 67 may be coupled to the feet of the rear props 50 and further similar hydraulic units can be disposed between the upper parts of these props 50 if desired. In such a case the laterally adjustable side wall 53' of the shield component 53 may be unnecessary. As can be appreciated, when the props 50 of the central frame II are relieved and the props 50 of the outer frames I, III are set to brace these frames between the roof and the floor the rams 63 can be extended to displace the central frame II towards the mineral face in the shifting direction. The movement of the frame II is then guided inter alia by the arm 61 and the guide bars 62 which slide along the stationary guide blocks 66. Conversely, when the props 50 of the outer frames I, III are relieved and the props 50 of the central frame II are set the rams 63 can be retracted to shift the outer frames, I, III towards the mineral face. Here the movement of the frames I, III is guided inter alia by the arms 61 and the guide bars 62 with the blocks 66 sliding along the stationary bars 62.

We claim:

1. A shield support assembly comprising three frames arranged in side-by-side relationship, the frames having a floor sill structure carrying hydraulic props capable of bracing the individual frames between the roof and floor of a mine working, means for guiding the frames for relative shifting displacement, means for effecting relative shifting displacement between the central frame and the outer frames and transverse coupling means extending between the central frame and the outer frames and supported by the central frame, said transverse coupling means being connected to the guide means, wherein the transverse coupling means and the guide means permit relative vertical mobility to occur between the floor sill structures of the frames, wherein the transverse coupling means is a transversally extending arm rigidly fixed to the central frame, the guide means comprises guide bars extending in the shifting direction and connected to the ends of the arm and slidably engaging in guide blocks carried by the outer frames, the engagement between the guide bars and guide blocks permitting relative pivotal movement and limited vertical movement therebetween.

2. An assembly according to claim 1, wherein the shifting means is operably connected to the transverse coupling means.

3. An assembly according to claim 1, wherein the shifting means comprises hydraulic rams coupled between the outer frames and the transverse arm and each taking an inclined disposition in plan view and wherein the guide bars each have a length which is only slightly greater than the stroke of the rams.

4. An assembly according to claim 1, wherein at least one hydraulic piston and cylinder unit is connected between adjacent frames for adjusting and maintaining the alignment therebetween.

5. A shield support assembly comprising three frames arranged in side-by-side relationship, the frames having a floor sill structure carrying hydraulic props capable of bracing the individual frames between the roof and floor of a mine working, means for guiding the frames for relative shifting displacement, means for effecting relative shifting displacement between the central frame and the outer frames and transverse coupling means extending between the central frame and the outer frames and supported by the central frame, said transverse coupling means being connected to the guide means, wherein the transverse coupling means and the guide means permit relative vertical mobility to occur between the floor sill structures of the frames, wherein the transverse coupling means is composed of two transversally extending arms each connected to the central frame for pivoting about an axis parallel to the shifting direction and each connected at its end remote from the central frame to a pair of guide bars forming at least part of the guide means.

6. An assembly according to claim 5, wherein the frames each have a floor sill structure composed of separate relatively vertically moveable parts and the parts of the floor sill structure of the central frame are each pivotably connected to a respective one of said arms.

7. An assembly according to claim 5, wherein the shifting means comprises hydraulic shifting rams and is located between a respective pair of guide bars.

8. An assembly according to claim 7 wherein each pair of guide bars are interconnected at their rear ends remote from the transverse arms by means of a yoke which supports a respective one of the shifting rams.

9. An assembly according to claim 6, wherein the shifting means comprises hydraulic shifting rams and is located between a respective pair of guide bars and wherein each pair of guide bars and the associated ram are located between the floor sill parts of the outer frames.

10. An assembly according to claim 6, wherein each pair of guide bars are interconnected at their rear ends remote from the transverse arms by means of a yoke which supports a respective one of the shifting rams and wherein the yokes are guided for pivoting and sliding in relation to the respective floor sill parts of the outer frames.

11. An assembly according to claim 6 wherein the shifting means comprises hydraulic shifting rams and is located between a respective pair of guide bars wherein each pair of guide bars are interconnected at their rear ends remote from the transverse arms by means of a yoke which supports a respective one of the shifting rams and wherein the shifting rams are connected to further yokes located forwardly of the first-mentioned yokes, each of the further yokes being pivotably connected to the floor sill parts of the respective outer frames for pivoting about axes extending parallel to the shifting direction.

12. An assembly according to claim 6, wherein there is further provided a hydraulic shifting ram disposed between the floor sill parts of the central frame, the ram being supported by yokes interconnecting the floor sill parts and the guide bars being connected to a rear one of said yokes remote from the transverse arms and serving for engagement with or coupling to a longwall conveyor.

* * * * *